United States Patent [19]

Cox et al.

[11] 4,084,941

[45] Apr. 18, 1978

[54] NON-POLLUTING WATERPROOF CLOTH FINISH FOR ABRASIVE CLOTH

[75] Inventors: William H. Cox; Norvell E. Wisdom, Jr., both of Watervliet, N.Y.

[73] Assignee: Norton Company, Worcester, Mass.

[21] Appl. No.: 672,431

[22] Filed: Mar. 31, 1976

[51] Int. Cl.[2] ..... B24D 11/02

[52] U.S. Cl. ..... 51/295; 51/298 A

[58] Field of Search ..... 51/295, 297, 298, 299

[56] References Cited

U.S. PATENT DOCUMENTS

| | | | |
|---|---|---|---|
| 2,269,415 | 1/1942 | Netherly et al. | 51/295 |
| 2,281,558 | 5/1942 | Cross | 51/295 |
| 3,787,273 | 1/1974 | Okrepkie et al. | 51/295 |
| 3,861,892 | 1/1975 | Wisdom et al. | 51/295 |
| 3,942,959 | 3/1976 | Markoo et al. | 51/295 |

*Primary Examiner*—Donald J. Arnold
*Attorney, Agent, or Firm*—Rufus M. Franklin

[57] ABSTRACT

A woven cellulosic cloth backing of cotton or rayon yarns for the manufacture of coated abrasives, particularly for the manufacture of coated abrasive belts for wet grinding, includes a backsize, of phenolic resin which may be admixed with a polymer having a glass transition temperature between 10° and 40° C, said backsize being directly adhered to the yarns of cloth, a polymeric film forming resin adhered to the yarns of cloth to which the backsize is not adhered, said resin having a glass transition temperature between 20° and 50° C, and a front size of a mixture of phenol-formaldehyde resin and the film former resin coating above referred to. An additional front coating of phenol-formaldehyde resin may be employed to provide a smooth surface for the application of a fine grit abrasive.

3 Claims, No Drawings

NON-POLLUTING WATERPROOF CLOTH FINISH FOR ABRASIVE CLOTH

BACKGROUND OF THE INVENTION

Traditional cloth finishes suitable as backing for waterproof coated abrasives have involved saturants and/or other finishing materials dissolved in organic solvents for application to the cloth. Driving off those solvents during manufacture thus leads to a potential air pollution problem. Increased attention to such pollution in recent years has motivated the development of waterproof cloth finishes utilizing only aqueous based finishing materials. While satisfactory for many operations, such finishes and the products coated on them have had substantially less stretch resistance and body than the most rugged traditionally finished products with saturants such as ethyl cellulose.

SUMMARY OF THE INVENTION

We have recently discovered a method of finishing standard desized abrasive cellulosic drills, jeans, sateens or other woven cloth constructions in such a fashion as to match or exceed the stretch resistance of the most rugged traditionally finished cloth and waterproof coated abrasive. Our method of finishing consists of the following sequence of operations:

1. Dimensioning the cloth while wet and drying it in a tenter frame or similar device so as to maintain the following dimensions: reducing the original greige width of drills cloth by 10–20%, preferably 14–17% or increasing the original greige width of sateens cloth by 0–5%, preferably 2–3%. The cloth should be maintained at or near the warp yarn count value obtained in this step throughout subsequent processing.

2. Applying to the back of the cloth by suitable conventional coating means, usually by knife coating, a mixture of the following components:

(a). 0–35% by weight, preferably 20–25% by weight of an aqueous dispersion (30–60% solids) of synthetic film forming polymer which in dried film form has a glass transition temperature (Tg) between 10° and 40 ° C, preferably a Tg between 20°–30° C (e.g. Dur-O-Cryl 820, manufactured by Chas. H. Tanner Division of Ciba-Geigy, Inc.; Hycar 2600X138, manufactured by B. F. Goodrich and Company).

(b). 15–60% by weight, preferably 25–35% by weight of resole phenol-formaldehyde or substituted phenol-formaldehyde resin having a water tolerance sufficient to prepare the mixture described without developing phase separation, a solids content of 50–85%, preferably 65–80%, and a viscosity of 1000–25,000 cps. preferably 10,000–20,000 cps. (e.g. Varcum 2535, Varcum 8169C, Varcum 5868 resins, all manufactured by Reichhold Chemicals, Inc. or BM-11, BM-42, BM-32, or V1237A resins, all manufactured by Friction Materials Division of Bendix Corp.).

(c). 0–75% by weight, preferably 40–55% by weight of a finely divided filler material such as calcium carbonate, calcium sulfate, dolomite, silica, clay, etc. having an average particle size less than 100 microns, preferably less than 25 microns.

(d). Up to 5% by weight, preferably less than 2% by weight of pigment or dye to produce a desirable color.

This mixture should have a viscosity of 700–10,000 cps. preferably 1000–4000 cps., and should be applied so as to give after drying an add-on weight level of 3–10 lbs./R (R = 1 sandpaper ream = 330 ft.$^2$), preferably 5–8 lbs./R. The viscosity and knife pressure and position should be adjusted so that no significant penetration of the treatment through to the front side of the cloth occurs, with most of the bulk of the treatment remaining atop the cloth yarns or filling the outer part of the interstices between them.

3. Applying to the front side of the cloth an aqueous dispersion of a polymer which in dried film form is insoluble in water and has a Tg between 20°–50° C, preferably between 30°–40° C. The solution may be applied by any convenient technique such as calender rolls. The solids content of the solution to be applied may range from 10–50% and the viscosity from 10–5000 cps., preferably between 500–2000 cps. The solids content, viscosity, and coating conditions should be adjusted so that the dry add-on weight is 0.5–4.0 lbs./R, preferably 1.0–1.5 lbs./R for drills cloth and 1.5–2.5 lbs./R for sateens. (See also next paragraph below). If needed, a thickening agent may be added to the solution to provide viscosity in the desirable range when relatively low solids content solutions are needed to maintain the deposition weight in the proper range. Anti-foam agents, wetting agents, and dyes or pigments may also be added. An example of a formulation found generally suitable is as follows:

39% by weight Hycar 2600X172 Acrylic ester polymer latex (product of B. F. Goodrich)
58% by weight water
2% by weight Acrysol ASE-60 thickening agent (product of Rohm & Haas)
0.7% by weight ammonium hydroxide
0.3% by weight Foamkill 608 (product of Crucible Chemical Co.) anti-foam agent Control of the weight and location of the material added in this step is a critical feature of our invention, as is the selection of a polymer with correct mechanical properties as indicated by its Tg value. If the add-on weight of this step is too low, the finished cloth will have inadequate tear resistance, while if the add-on is too high, stretch-resistance will be inadequate. Similarly, if the polymer chosen is too rigid, there will be inadequate tear resistance, while if the polymer is too flexible, stretch resistance will suffer. If the viscosity is too high, the polymer will tend to remain outside the fiber bundles of the yarns or too near the top surface of the cloth, while if the viscosity is too low, the applied mixture may tend to run through the cloth rather than remaining in place in the interior. We believe that the best values for all these parameters are within the ranges given as preferable above, if the object is to match the properties of conventional wateproof cloth finishes, but other variations may be useful to vary specific properties in the directions indicated.

4. Applying to the front side of the cloth, over the dried treatment described in part 3, a mixture consisting of 30–70% by weight of solids, preferably 45–55% by weight of solids, of an aqueous dispersion of the type described in part 3, together with 30–70% by weight of solids, preferably 45–55% by weight of solids, of a phenolic resin of the type described in part 2*b*. This mixture should also contain sufficient ammonium hydroxide to give it a pH between 6.5 and 12, preferably between 7.0 and 9.0 and sufficient additional water to give a convenient viscosity for application by calender roll or other convenient conventional technique so that the dried add-on weight is 1.0–4.0 lbs./R, preferably 1.5–2.5 lbs./R. Normally a suitable viscosity would lie between 300–5000 cps.

At this stage, the cloth is suitable for coating on its front surface with conventional phenolic resin adhesives and abrasive grain, particularly in coarse grits. If a smoother coating surface is deired, as is usual for fine grits, an additional finishing operation should be carried out as set forth below:

5. Apply to the front of the cloth, over treatment 4. above, a mixture consisting of (a) 30–100% of solids of a phenolic resin or mixture of resins suitable for use as a maker adhesive for caoted abrasives as well known in the art, (b) 0–70% of solids weight of a finely divided filler material as described in part 2(c) above, and (c) 0–5% of solids of wetting agents, dyes, pigments, etc. as desired for appropriate coating characteristics. This mixture may be applied by any conventional coating technique, with knife-coating generally preferred. If knife coating is used, the mixture should be applied from solution in additional water if needed so as to produce a viscosity of 500–5000 cps. and should be applied in sufficient quantity to yield a dry add-on weight of 2–9 lbs./R, preferably 4–6 lbs./R. If desired, the surface of the dried finished cloth can be further smoothed by conventional high pressure calendering.

DESCRIPTION OF SPECIFIC EMBODIMENTS

Illustrative of a specific example of the practice of our invention is as follows:

cloth: a desized 76 × 48 cotton drills
warp yarns — 12½'s cotton staple
fill yarns — 17's cotton staple
weight: 6.2 ounces/yd$^2$ The first treatment of the cloth is the application to the back, by knife coating 7 pounds per ream (dried weight) of a mixture of phenolic resin with acrylic resin latex, and fillers as follows:

BM-32,
Resole phenolic resin having a viscosity of 500 centipoises at 77° F, 75% solids, — 29.3%
Hycar acrylic 2600X138, 50% solids — 20.6%
$CaCO_3$ filler — 44.4%
Carbon black — 1.1%
Water added — 15.5%

Next there is applied to the front side of the cloth, so that it penetrates to the at least partially dried and cured back coating, a resin treatment in the amount of 1.3 pounds per ream formulated from:

Hycar 2600X172 Acrylic polymer latex containing 19.5 parts by weight of resin solids and 58% by weight of water, to which is added
0.76 parts Acryol ASE-60 thickening agent (from Rohm & Haas)
0.7 parts $NH_4OH$
0.3 parts Foamkill 608 (from Crucible Chemical Co.)

The glass transition temperature of this formulation after drying is 33° C.

The third application to the cloth is made on the front side, over the dried acrylic coating, in the amount of 2 pounds per ream, of the following formulation:

Hycar 2600X172 (50% solids) — 50%
BM-32 phenolic resole resin (75% solids) — 33.3%
water — 16.7%

After drying the backing is ready for use in making coated abrasive sheet by applying maker coat, grain and a size coat to the front side, and curing by heat in any conventional manner, for example as taught in U.S. Pat. No. 3,011,882.

If fine grit (e.g. 120 grit) is to be employed, the additional finish operation (5) above may be employed.

What is claimed is:

1. A woven cellulosic fabric cloth backing having a weight of 4 to 9.5 oz/yd$^2$ for the manufacture of a coated abrasive sheet by the application to its front face of a mixture of abrasive and phenolic resin, having a cured phenol-formaldehyde backsize containing from 0 to 35% of an acrylic film forming polymer having a glass transition temperature between 10° and 40° C, said backsize lying on the cloth surface and penetrating only partially into the interstices of the yarns and being present in the amount of 3 to 10 pounds of dry coating per ream, the portion of the cloth not adhered to said backsize, being coated with an acrylic film forming polymer having a glass transition temperature of between 20° and 50° C, said last named polymer being present in the amount of from 0.5 to 4 pounds per ream, and a front size overlying said last named polymer consisting of 30 to 70% by weight of phenolic resin, and from 30 to 70% by weight of a film forming polymer having a glass transition temperature between 20° and 50° C, said front size being present in the amount of from 1 to 4 pounds per ream, dry weight.

2. A coated abrasive backing as in claim 1 having a phenol-formaldehyde layer overlying said front size for presentation of a smooth surface for the application of a phenolic bonding layer and a fine grit abrasive.

3. A coated abrasive sheet comprising the backing of claim 1 having abrasive grains adhered to the front side by a cured phenolic coating.

* * * * *